US005992530A

United States Patent [19]

Sundholm

[11] Patent Number: 5,992,530

[45] Date of Patent: Nov. 30, 1999

[54] INSTALLATION FOR FIGHTING FIRE

[76] Inventor: Göran Sundholm, Ilmari Kiannon Kuja 3, FIN-04310 Tuusula, Finland

[21] Appl. No.: 09/051,352

[22] PCT Filed: Sep. 5, 1997

[86] PCT No.: PCT/FI97/00523

§ 371 Date: Apr. 8, 1998

§ 102(e) Date: Apr. 8, 1998

[87] PCT Pub. No.: WO98/09684

PCT Pub. Date: Mar. 12, 1998

[51] Int. Cl.[6] ..... A62C 35/00

[52] U.S. Cl. ..... 169/16; 16/5; 16/9

[58] Field of Search ..... 169/5, 9, 16, 14, 169/15

[56] References Cited

U.S. PATENT DOCUMENTS

| | | | |
|---|---|---|---|
| 2,586,797 | 2/1952 | Dunlop et al. . | |
| 4,091,874 | 5/1978 | Monma | 169/46 |
| 4,401,165 | 8/1983 | Gutermuth et al. | 169/54 |
| 5,702,299 | 12/1997 | Sundholm | 169/91 X |

FOREIGN PATENT DOCUMENTS

| | | |
|---|---|---|
| 2215204 | 9/1989 | United Kingdom . |

OTHER PUBLICATIONS

International Publication No. WO 94/26356, dated Nov. 24, 1994, to G. Sundholm entitled, "Method and Installation for Removing Smoke from a Monitored Space".

International Publication No. WO 93/21997, dated Nov. 11, 1993, to G. Sundholm entitled, "Installation for Fighting Fire".

*Primary Examiner*—Andres Kashnikow
*Assistant Examiner*—Robin O. Evans
*Attorney, Agent, or Firm*—Watson Cole Grindle Watson, P.L.L.C.

[57] ABSTRACT

An installation for fighting fire in a space which includes a spray head (1*a'*, 2*a'*) of such a type that it is capable of producing extinguishing medium in the form of a finely divided liquid mist with a great penetrating ability and a simultaneous suction near the spray head. To obtain an installation which as regards its construction is simple and with which a fire in a space can be very efficiently extinguished so that the fumes are purified at the same time as the amount of water can be very small, the spray head (1*a'*, 2*a''*, 1*b'*, 2*b'*) is arranged in a pipe (3*a'*, 3*b'*) with a suction opening (67*a'*, 67*b'*) at a distance of 1 to 10 m from the floor level (24) of the room and a spray opening (45*a'*, 45') near the floor level, whereby the spray head is arranged to spray in the direction from the suction opening to the spray opening to create a suction in the suction opening.

20 Claims, 4 Drawing Sheets

INSTALLATION FOR FIGHTING FIRE

BACKGROUND OF THE INVENTION

1. Field of the Invention

The present invention relates to an installation for fighting fire in a space, the installation including a spray head of such a type that it is capable of producing extinguishing medium in the form of a finely divided liquid mist with a great penetrating ability and a simultaneous suction near the spray head.

2. The Prior Art

Such installations are known from the publications WO 92120453, WO 92/22353 and WO 94/16771. These known installations have proved to function very well for fire extinguishing. To prevent the drop size of the extinguishing liquid from becoming too large, an installation in which gas is mixed into the extinguishing liquid has been disclosed in WO 94/08659. As a result of the intermixing of gas, it has been possible to keep the drop size comparatively small during the emptying of an hydraulic accumulator.

Some spaces, such as rooms for computers and other machines, contain, in addition to expensive machines, bundles of electric cables, which in the event of a fire cause great damage. The electric cables typically have a plastic mantle of PVC. If a fire breaks out in such a room and the cables catch fire, poisonous fumes are formed and these fumes are not only dangerous to humans but also destroy sensitive machines, such as computers. Known installations for extinguishing such fires are not capable of rapidly extinguishing a fire with a small amount of water. The use of something else than a water-based extinguishing medium, e.g. halogen, for extinguishing produces chemicals that are harmful to the surrounding, wherefore the use of a water-based extinguishing medium is to be preferred. It is important that the quantity of water used for extinguishing a fire is not large, since the water damages can then be kept small.

The present invention relates to a new installation which has, if desired, a simple construction and with which a fire in a space, e.g. a room, can be extinguished very efficiently so that the smoke gases and fumes are purified and the amount of extinguishing liquid used can be very small at the same time.

SUMMARY OF THE INVENTION

For this object, the installation according to the invention is principally characterized in that the spray head is arranged in a pipe with a suction opening at a distance of 1 to 10 m from the floor level of the space and a spray opening near the floor level, whereby the spray head is arranged to spray in the direction from the suction opening to the spray opening to create a suction in the suction opening.

To achieve a better effect in larger spaces, the pipe preferably constitutes part of a pipe system comprising a plurality of spray openings for spraying extinguishing medium in the form of mist out of the pipe system at least essentially along the floor, and a plurality of suction openings, whereby the further pipe system has a first elongated pipe section and a second elongated pipe section, and an intermediate pipe section which connects the first elongated pipe section with the second elongated pipe section, whereby the spray openings are arranged in the second elongated pipe section in the longitudinal direction thereof and the suction openings are arranged in the first elongated pipe section in the longitudinal direction thereof, whereby the second elongated pipe section is arranged near the floor level of the room and the first elongated pipe section is arranged at a distance of 1 to 10 m above the floor level.

In large spaces, the installation preferably comprises a further pipe system arranged at a distance from the pipe system so that the pipe systems are placed near the opposite walls of the space. The fumes are as a result efficiently sucked out without any intermixing of the fumes taking place in the space. To effect smoke suction and fire extinguishing in a room with a sub-floor, the installation further comprises a pipe net arranged in the subfloor, whereby at least one spray head has been arranged in said pipe net to spray extinguishing medium in the form of mist into the pipe net, whereby the pipe net comprises spray openings for spraying mist out of the pipe net and suction openings for sucking fumes into the pipe net and for producing a flow of extinguishing medium from the spray openings towards the suction openings, whereby the pipe net has a first elongated pipe part and a second elongated pipe part, and an intermediate pipe part connecting the first elongated pipe part with the second elongated pipe part, whereby the first elongated pipe part is directed at least essentially parallel to the second elongated pipe part, and the spray openings and the suction openings are arranged in the elongated pipe parts in the longitudinal direction of said elongated pipe parts.

The greatest advantages of the installation according to the invention are that it is possible to extinguish a fire with a simple equipment and that the fumes are efficiently purified at the same time. The installation also makes it possible to extinguish a fire in an "environment friendly" manner by using a very small amount of extinguishing liquid, which will cause minimal material damages.

BRIEF DESCRIPTION OF THE DRAWINGS

In the following, the invention shall be described in more detail with reference to the enclosed drawing in which.

DETAILED DESCRIPTION OF THE PREFERRED EMBODIMENTS

Figure 1:
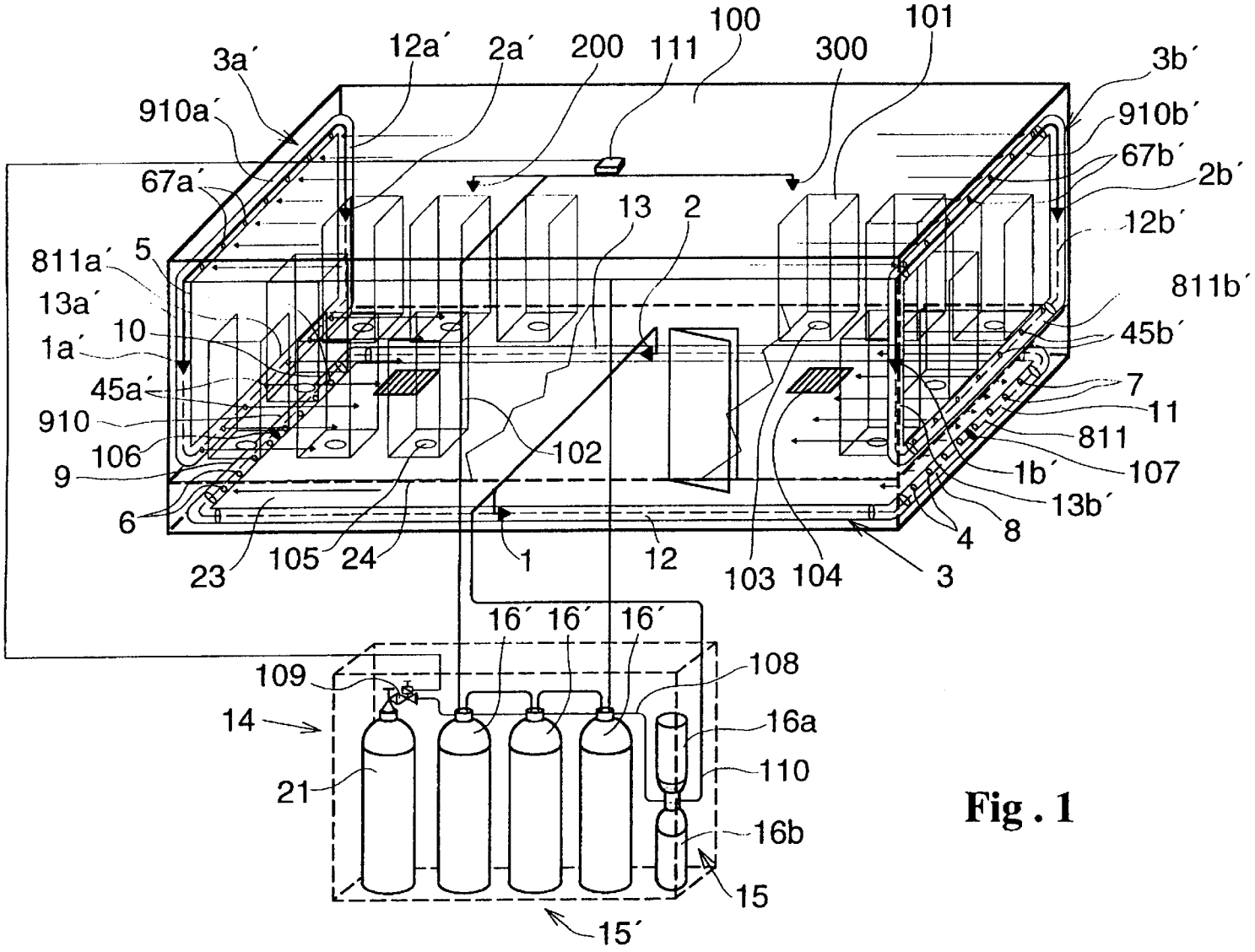
FIG. 1 shows a preferred embodiment of the invention.

In FIG. 1, the numeral 100 designates a room equipped with a fire extinguishing installation according to the invention. The room 100 shown is a room intended for computers 101, 102 and having openings 103 to 105 to a subfloor 23 of the room, but the room can in principle be any kind of room. The subfloor 23 contains a lot of cables (not shown) for the computers 101, 102 and for other machines (not shown). The openings 103 to 105 are intended for cables to the computers 101, 102 and to provide the computers with cooling air. The invention is particularly suited for use in a room with expensive machines which are damaged by fumes and/or water. The reference numerals 200 and 300 indicate heat-sensitive sprinklers arranged near the ceiling of the room 100. These sprinklers are preferably of such a type that they are capable of generating extinguishing medium in the form of a finely divided liquid mist with a great penetrating ability or momentum and a simultaneous suction near the spray head. Due to the penetrating ability, the extinguishing medium is able to reach into the seat of fire. Such sprinklers have been described in the publications WO 92/20453, WO 92/22353 and WO 94/16771.

The installation comprises two rectangular pipe systems 3*a*', 3*b*' arranged at a distance from one another above the subfloor 23 at the end walls of the room 100, whereby spray heads 1*a*', 2*a*', 1*b*', 2*b*' of the same type as the sprinklers 200 and 300 have been arranged in said pipe systems, i.e. spray heads which under great pressure are capable of producing extinguishing medium in the form of a finely divided liquid mist with a great penetrating ability and a simultaneous suction near the spray head. Preferably, the spray heads 1*a*', 2*a*', 1*b*' 2*b*' are of the type described in the publications WO 92/20453, WO 92/22353 and WO 94/16771.

The pipe system 3*a*' comprises a first elongated pipe section 910*a*', a second elongated pipe section 811*a*' and intermediate pipe sections 12*a*' and 13*a*' which connect the first and the second elongated pipe section and in which a respective spray head 1*a*' and 2*a*' has been arranged. The second elongated pipe section 811*a*' has a number of spray openings 45*a*', e.g. 3 to 10, and the first elongated pipe section 910*a*' has a number of suction openings 67*a*', e.g. 3 to 10. The spray openings 45*a*' are arranged in the longitudinal direction of the pipe section 811*a*' and the suction openings 67*a*' are arranged in the longitudinal direction of the pipe section 910*a*'. The function of the suction openings 67*a*' is to suck fumes into the pipe net 3*a'*.

The pipe section 811*a*' is arranged immediately above the floor plane 24 to spray liquid mist essentially in the direction of the floor. The pipe section 910*a*' has been arranged at a distance of about 3 m above the floor level 24. Said distance can of course vary depending on the application. A distance of about 1 to 5 m between the pipe sections 811*a*' and 910*a*' produces a good result for most of the applications that occur in practice, but the distance can be up to about 10 m, if the room is very high. The pipe sections 910*a*' and 811*a*' are located essentially in the same plane which is essentially transverse to the floor plane 24.

The pipe sections 811*a*', 910*a*' are made of plastic and may have a diameter of, for example, 100 to 150 mm. The diameter of the spray and suction openings is preferably 5 to 40 mm.

The pipe system 3*b*' is constructed like the pipe system 3*a*' and it is placed with respect to the walls of the room and the floor level 24 in the same manner as the pipe system 3*a*' is placed with respect to the walls of the room and the floor level. The corresponding parts have been indicated with the corresponding reference marks except that the letter "a" has been replaced by the letter "b" in the reference marks. The pipe system 3*b*' functions in the same way as the pipe system 3*a'*.

A rectangular pipe net generally indicated by the reference numeral 3 has been arranged in the subfloor 23 of the room 100, the upper level 24 of the subfloor being indicated by a dashed line. Two spray heads 1, 2 which are of the same type as the spray heads 1*a*', 2*a*', 1*b*', 2*b*' have been arranged in the pipe net 3.

The pipe net 3 comprises a first elongated pipe part 910 and a second elongated pipe part 811. The pipe part 910 is located essentially in the same plane as the pipe sections 910*a*' and 811*a*'; and the pipe part 811 is located essentially in the same plane as the pipe sections 910*b*' and 811*b*'. The diameter of the pipe parts 910, 811 can be, for example, 100 to 150 mm and they are made of plastic. The pipe parts 910, 811 are at their ends connected with a first intermediate pipe part 12 in which the spray head 1 has been placed and a second intermediate pipe part 13 in which the spray head 2 has been placed. The spray heads 1 and 2 have been placed in the middle of the pipe parts 12 and 13, respectively, but it is conceivable that they may be located somewhere else in the pipe net 3. The spray heads 1 and 2 are arranged to spray in opposite directions so that the spray head 1 sprays towards the pipe part 811, whereas the spray head 2 sprays towards the pipe part 910. The first pipe part 910 has four spray openings 5 and four suction openings 6. The spray openings 5 in the pipe part 910 are separated from the suction openings 6 by a plug 106. The second pipe part 811 has correspondingly four spray openings 4 and four suction openings 7, and a plug 107. The spray openings 4 are arranged to spray extinguishing medium towards the suction openings 6. The spray openings 5 are arranged to spray extinguishing medium towards the suction openings 7. The diameter of the spray openings 4, 5 and the suction openings 6, 7 is preferably 5 to 40 mm, depending on, for example, the application and the number of apertures 4 to 7.

As a drive source for feeding extinguishing medium to the sprinklers 200, 300, to the spray heads 1*a*', 2*a*', 1*b*', 3*b*' and to the spray heads 1, 2, the installation comprises a drive unit which is indicated by the reference numeral 14 and which comprises hydraulic accumulators 15, 15' which consist of three pressure containers 16' with a volume of 50 l each and two pressure containers 16*a*, 16*b* with a volume of 10 l each. The pressure containers 16', 16*a*, 16*b* contain extinguishing liquid composed of water-based liquid, i.e. water with or without additives. The pressure containers 16' are filled to about 80% prior to the emptying of the containers and the start of the extinguishing. The number and size of the pressure containers may vary depending on the application and the size of the room 100. In the case of a large room, the pressure containers are usually required to have a larger volume. The volume of the pressure containers 16*a*, 16*b* can be, for example, half the size in the case of smaller rooms.

The pressure containers 16', 16*a*, 16*b* which provide the sprinklers 200, 300 and the spray heads 1*a*', 2*b*' and the spray heads 1, 2, respectively, with extinguishing medium are connected through a conduit 108 to a gas bottle 21 with a volume of 50 l. The pressure containers 16' are provided with a respective rising tube 17'. The volume of the gas bottle 21 is selected on the basis of the volume of the room 100 and other factors. The gas is nitrogen gas with a pressure of 200 bar. A gas bottle 21 of different pressures can be used: the pressure is typically 100 to 300 bar prior to the onset of the extinguishing. The advantage of using nitrogen is that a suitable weight is obtained for the extinguishing liquid so that the liquid can first settle against the floor, after which the gas component of the extinguishing medium can later rise and thus reduce the oxygen content in the room 100 and in this manner extinguish the fire or at least keep it under control. Instead of nitrogen gas, incombustible gas, such as argon or carbon dioxide, can be used.

Figure 2:
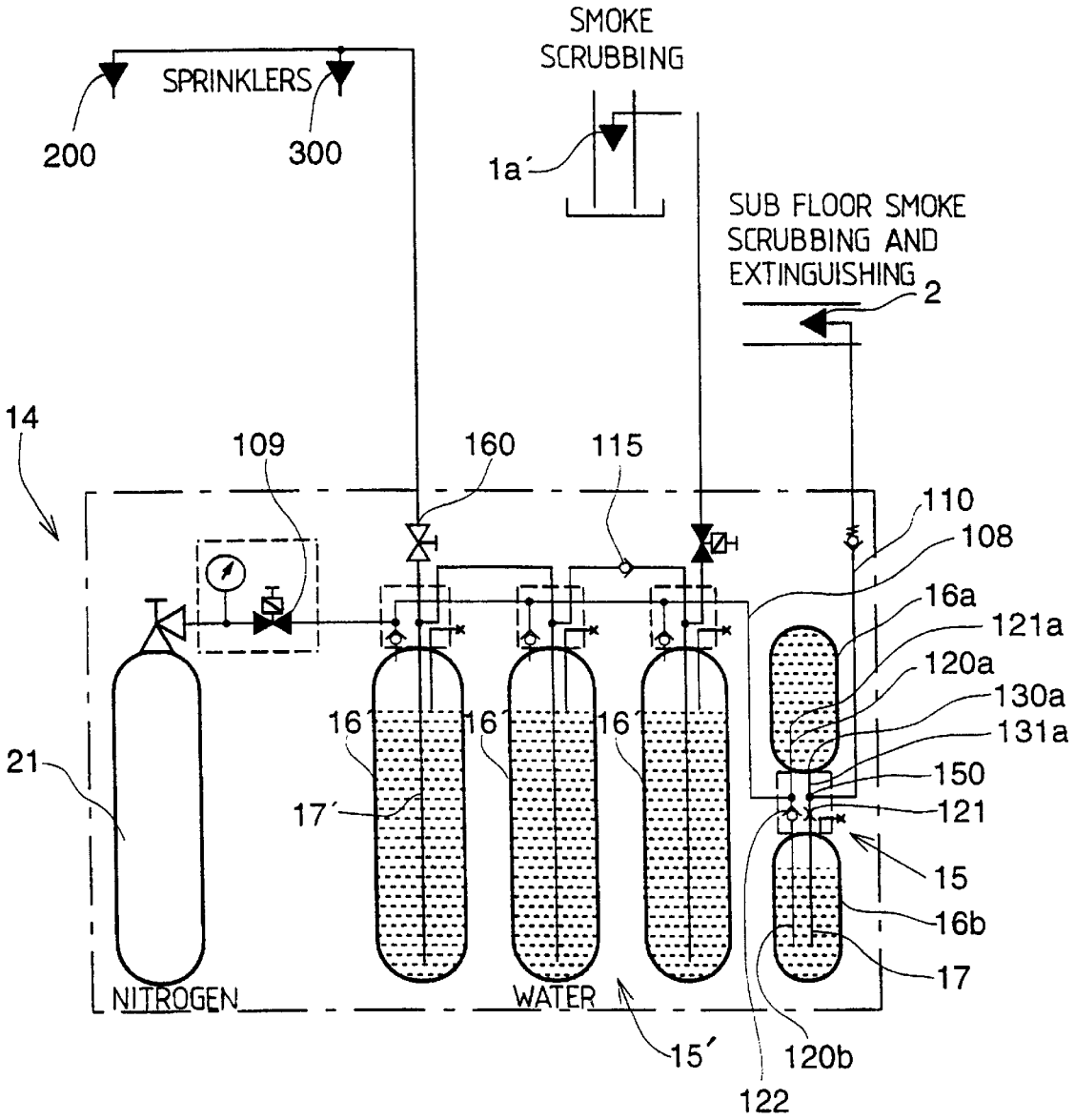
FIG. 2 shows the drive unit in FIG. 1 in more detail.

The reference numeral 115 indicates a nonreturn valve which prevents medium from flowing via the rising tubes 17' of the two pressure containers 16' to the left to the pressure container 16' furthest to the right but which allows an opposite flow of the medium, cf. FIG. 2.

Figure 3:
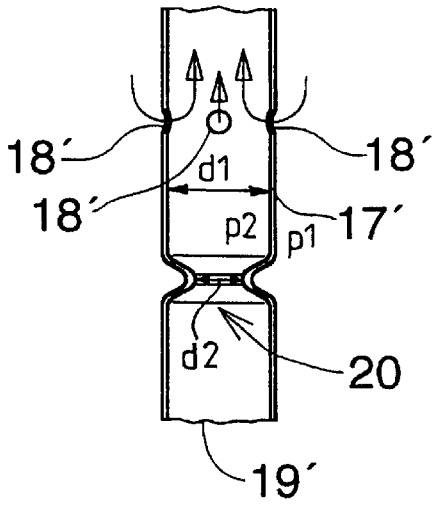
FIG. 3 shows a detail of FIG. 2 and FIGS. 4 to 6 show alternative solutions of the details of the invention.
Figure 4:
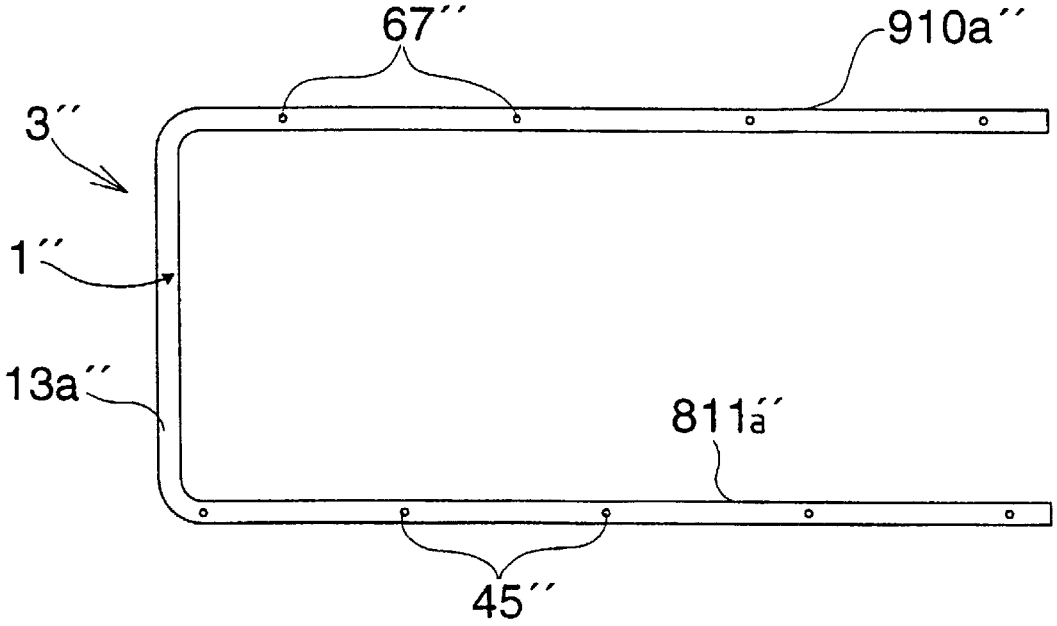

The drive unit 14 is illustrated in more detail in FIG. 2; FIG. 3 shows a detail of FIG. 2. The rising tubes 17' of the pressure containers 16' comprise three side openings 18' in the lower part so that about 70% of the rising tube is located above the side openings and about 30% is located below the side openings. At the bottom of the rising tube 17', there is a feed opening 19'.

It appears from FIG. 3, which shows the lower part of the rising tube 17' enlarged, that the lower part of the rising tube 17' is contracted by a throttle 20'. The throttle 20' has been formed in the lower part of the rising tube 17' below the side opening 18' of the rising tube. The throttle 20' is formed by a constriction in the rising tube 17'. The constriction forms an opening with the diameter d2=0.5 mm, whereas the nominal diameter d1 of the rising tube 17' is typically in the range of 8 to 15 mm. The throttle 20' preferably has the diameter d2=0.2 to 4 mm and most preferably 0.3 to 2 mm. The selection of the diameter d2 for the throttle 20' depends on many factors, such as the type of spray head 200, 300, 1*a*', 2*a*', 2*b*', the number of spray heads, the propellant pressure in the gas bottle 21, the type of gas, the diameter d1 of the rising tube 17', the size and number of the side openings 18', the indented use of the installation, i.e. the type of fire to be fought.

The pressure containers 16*a*, 16*b* comprise gas feeding pipes 120*a*, 120*b* through which their contents are connected to the conduit 108 for supplying the pressure containers with gas from the gas bottle 21.

The reference numeral 122 indicates a nonreturn valve which prevents fluid from flowing from the pressure container 16*b* to the gas bottle 21 or to the pressure container 16*a*.

Prior to use, i.e. prior to the onset of the extinguishing, the pressure container 16*a* is filled with water. The outlet mouth 121*a* of the gas feeding pipe 120*a* is arranged at a sufficiently great distance, e.g. some twenty or thirty centimeters, from the opening 130*a* on the bottom of the pressure container 16*a*, whereby water is conveyed, through said opening 130*a*, out of the pressure container to an outfeed pipe 110 which leads to the spray heads 1, 2. A minimum distance of at least about 4 cm is presumably required. Said distance is required so that gas will not flow into the opening 130*a* before the pressure container 16*a* has been emptied of water. A duct leading to the out-feed pipe 110 which leads to the spray heads 1, 2 is indicated by 131*a*.

The pressure container 16*b* is filled to about 80% with water before it is emptied, cf. FIG. 2. In the gas space in the upper part of the pressure container 16*b*, nitrogen gas is fed from the gas bottle 21 with a high pressure so that a pressure of, for example, 140 bar is formed before the emptying of the accumulator 15 starts. The pressure container 16*b* has a rising tube 17 which extends down from the pressure container up to the outfeed pipe 110. In connection with the rising tube 17, a throttle 121 has been arranged. The function of the throttle 121 is to offer a flow resistance which is sufficiently great for the water so that the pressure container 16*a* is first emptied of water, after which the emptying of the pressure container 16*b* through the throttle can begin.

The pressure container 16*a* is employed for purifying fumes and smoke gases, and the pressure container 16*b* for providing an extremely finely divided mist comprising water drops and nitrogen gas.

The installation according to FIG. 1 is put into operation by means of a signal from a smoke detector 111 placed near the level of the ceiling of the room 100. The signal causes a solenoid valve 109 arranged between the gas bottle 21 and the pressure containers 16', 16*a*, 16*b* to open. It is conceivable that the sprinklers 200, 300 of the installation may be of a pressure-balanced type, e.g. as disclosed in WO 92/15370 and WO 94/1677, and be, alternatively, released by heat. When the valve 109 is caused to open by a signal, nitrogen gas is fed into the pressure containers 16', 16*b*, in which an initial pressure of, for example, 140 bar is formed. This pressure is formed in the gas space of the pressure containers 16', 16*b* in the upper part of the pressure containers. The gas space in the pressure containers 16' and 16*b* constitutes about 20% of the volume of the pressure containers, cf. FIG. 2. The nitrogen functions as propellant gas for driving water out of the pressure containers 16', 16*a*. Owing to the fact that the pressure container 16*a* does not have a rising tube for the water, no freezing of water can occur; instead, the pressure container 16*a* is positively emptied of water by the pressure from the gas bottle 21. After the pressure container 16*a* has been emptied of water, gas starts to flow via the opening 130*a* into the outfeed pipe 110 at the same time as water from the pressure container 16*b* flows, due to the pressure in the pressure container, via the throttle 121 to the duct 131*a* and is mixed into the gas. The ratio of the amount of gas coming through the pressure container 16*a* to the amount of water coming from the pressure container 16*b* is, for example, 300:1 and suitably in the range of 100:1 to 500:1. This causes a very fine mist to be generated from the spray heads 1, 2. The gas pressure in the upper part of the pressure container 16*b* is what causes the water initially to flow to the outfeed pipe 110.

At the same time—or with some delay by a timer—as the pressure container 16*a* is emptied, the pressure containers 16' are emptied so that water flows in through the feed opening 19' of the rising tube 17' and the side openings 18'. When emptying the pressure container 16', its water level sinks, as a result of which the volume of the gas space of the pressure container for gas increases. The proportion of gas/water leaving the rising tube 17' is determined on the basis of the position of the water level in the pressure container 16'. In the beginning, the side openings 18' and the feed opening 19' provide only water through the throttle 20 into the rising tube 17'. Gas should not be mixed into the extinguishing liquid at the start of the extinguishing, since in that case the suction which is initially required in the suction openings 6, 7, 67*a*', 67*b* is not accomplished. The water is used for the suction and purification of the smoke gases or fumes; simultaneously, the fire is cooled. When the water level has reached the level of the side openings 18' and, for example, 1 to 3 l of water has been sprayed out from the pressure container 16', the mixing of nitrogen gas in the water begins as nitrogen gas flows through the side openings 18'. The gas pressure has then fallen to a value considerably below 140 bar. Since the gas pressure in the pressure container 16' has fallen considerably by comparison, the amount of gas required to obtain small droplets, e.g. 10 to 20 $\mu$m, is comparatively large. The drop size increases with the falling pressure if the rest of the parameters are kept unchanged. In spite of the fact that gas is mixed into the extinguishing liquid, smaller droplets with a greater velocity are obtained and the suction openings 6, 7, 67*a*', 67*b*' are capable of functioning in the desired manner, owing to the strong initial suction produced at the beginning of the extinguishing, so that a flow of medium from spray openings 4, 5, 45*a*', 45*b*' to suction openings 6, 7, 67*a*', 67*b*' takes place. The emptying of the pressure containers 16' continues until the pressure container has been completely emptied of water if the valves 109 and 160 are not closed.

As a result of the throttle 20', a relatively great pressure difference p1−p2 is formed, at the side openings 18', from the area outside to the area inside the rising tube 17', cf. FIG. 3. This pressure difference, which, for example, can be in the order of 50 bar, causes nitrogen gas to flow efficiently in through the openings 18' when the water level in the pressure container 16' has sunk to a level below the side openings 18'. Due to the fact that gas can effectively flow into the side openings 18', it is possible to obtain, as a result, a drop size of the sprays discharged from the spray heads 1*a*', 2*a*', 1*b*', 2*b*', 200, 300 that is very small, e.g. 10 to 20 $\mu$m and even less than 10 $\mu$m, at the end of the extinguishing. Since the intermixing of gas is efficient, a small amount of water will suffice.

Side openings can of course be arranged at different heights of the rising tube 17', whereby it is possible, through the height position and dimension of the side openings, to achieve the desired drop size and consistency of the extinguishing medium during the emptying process. Hereby the throttle is arranged below the lowermost side opening, whereby a large pressure difference is obtained at all of the side openings, which is advantageous in the attempt to mix as large a quantity of gas as possible into the liquid. It is, however, conceivable that side openings may be provided both above and below the throttle 20'. However, it is important that the throttle 20' has been arranged below the uppermost side opening, whereby a greater pressure difference is obtained at least at this side opening, inducing gas to flow in through the side opening when the water level has sunk to the height level of this opening.

If the throttle 20'is formed by an aperture with a diameter d2 that is sufficiently small in relation to the diameters of the side openings 18', the pressure difference p1−p2 grows very large, and liquid can flow in through the side openings. The diameter of the side openings is preferably between 0.5 and 5 mm and most preferably between 1 and 3 mm. In the embodiment in FIG. 1, the side openings have a diameter of 2 mm.

The rising tubes 17' in the pressure containers 16' do not necessarily require side openings 18' and a throttle 20'.

By the pipe net 3, two flows of medium sweeping in opposite directions in the subfloor 23 along the floor are formed, and by the pipe systems 3*a*', 3*b*', fume suction in the upper part of the room 100 is also produced. This will be explained in the following.

When the installation in FIG. 1 is put into operation after the smoke detector 111 has given a signal to the drive unit 14, the spray heads 200, 300, 1, 2, 1*a*', 2*a*', 1*b*', 2*b*' first start to spray a mist-like liquid spray without a nitrogen addition. The spray heads 1*a*', 2*a*', 1*b*', 2*b*' spray along the intermediate sections of the pipe systems 3*a*' and 36' so that initially purified (air purified from smoke gases and fumes) and later water mist containing nitrogen gas is discharged from the spray openings 45*a*', 45*b*'. The spray heads 1, 2 spray along the intermediate parts 12, 13 of the pipe system 3 so that initially purified air is sprayed from the spray openings 4, 5, after which mist is discharged from the spray openings 4, 5. At the same time as the spray heads 1*a*', 2*a*', 1*b*', 2*b*', 1, 2 spray, they create a strong suction behind them and a suction is created in the suction openings 67*a*', 67*b*' and 6, 7, respectively. Fumes are sucked into the suction openings and are absorbed in the mist-like sprays from the spray heads. These absorbed fumes stay absorbed in the extinguishing medium in the pipe systems 3*a*', 3*b*' and in the pipe net 3. As a result of the fact that the pipe systems 3*a*', 3*b*' and the pipe net 3 suck in fumes and smoke gases, the air in the room 100 is purified so efficiently from fumes and smoke gases that they do not cause any damages and harm.

Figure 5:
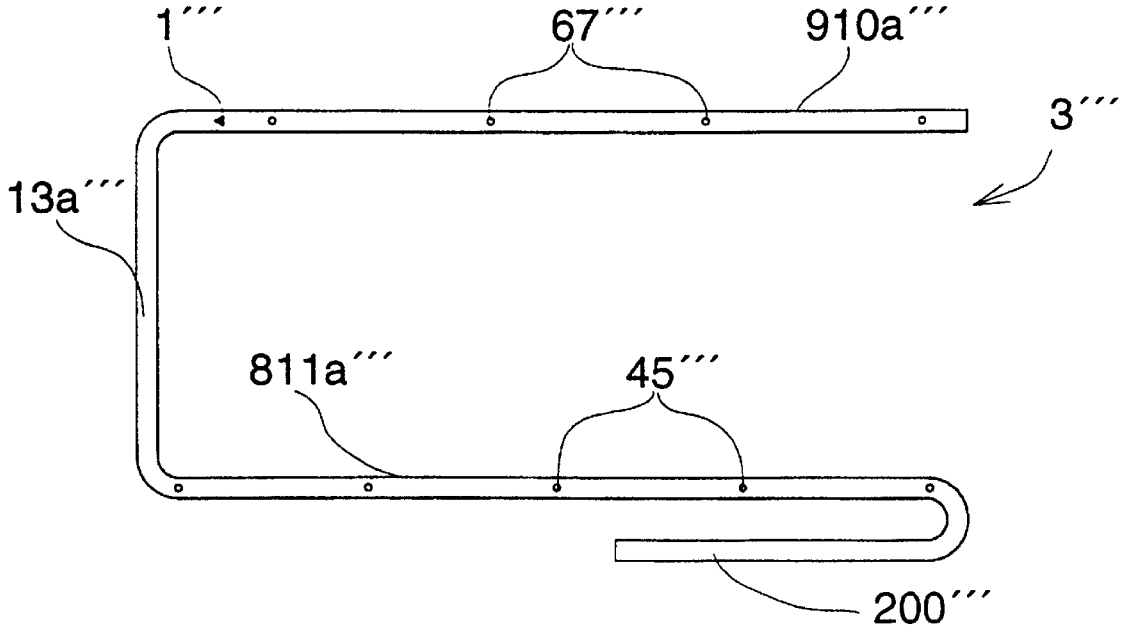
Figure 6:
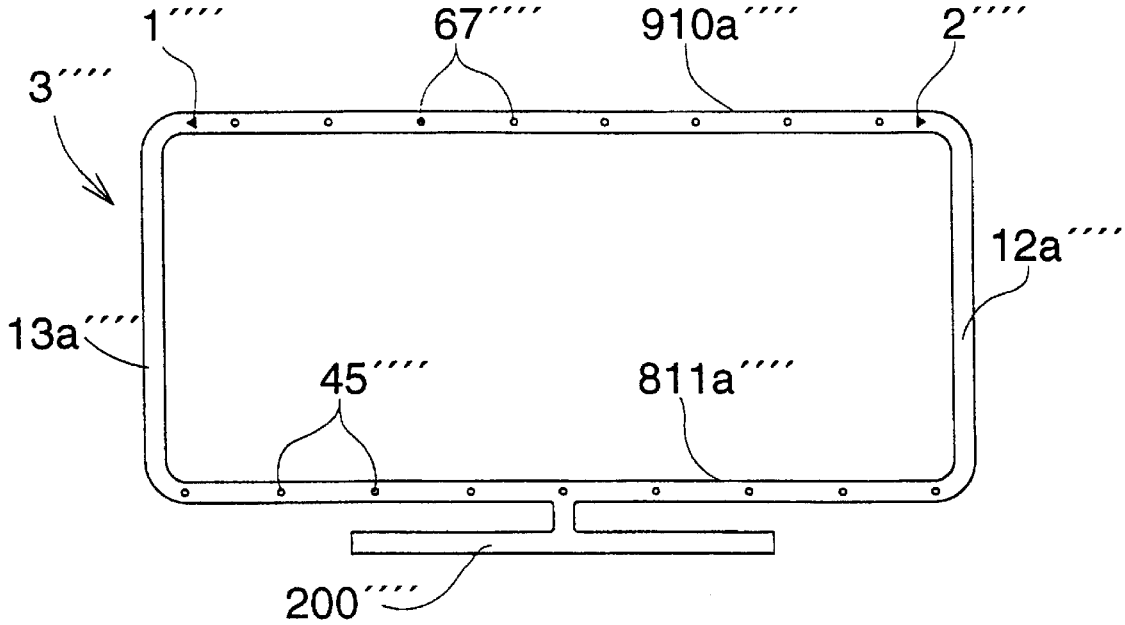

To gather fume residues, the intermediate pipe parts 12, 13 preferably have recessed spaces (not shown) in the otherwise straight pipe parts. The spaces are placed on the pressure side of the spray heads 1, 2. The pipe systems 3*a*', 3*b*' may have, at the lower part, a collecting receptacle of the kind shown in FIGS. 5 and 6 and indicated by the reference numerals 200''' and 200''''.

When the pressure containers 16*a*, 16*b*, 16' have been emptied of extinguishing liquid, the room 100 and the subfloor 23 are purified from fumes and smoke gases, the subfloor is filled with extinguishing medium mist containing nitrogen gas, and the room, particularly the lower part thereof, is filled with a mist-like spray which after a while sinks towards the floor. Due to the water in the extinguishing medium, the extinguishing medium mist in the subfloor 23 and the extinguishing medium mist near the floor level 24 are comparatively heavy, and the extinguishing medium mist sprayed into the subfloor 23 and the extinguishing medium mist above the floor remain at first in the subfloor and at the floor level of the room, respectively, extinguishing smoldering fire. After a period of typically a few minutes, the water slowly sinks down and the nitrogen gas is liberated from the water and begins to rise in the room, since it is lighter than air. When the nitrogen gas rises, it extinguishes, on the way up, all seats of fire possibly still smoldering in the room. It is very interesting that the nitrogen gas will enter the computers 101, 102 due to the "chimney effect" so that the nitrogen gas rises along the computers, which function as a chimney. Nitrogen gas flows into the computers 101, 102 through the apertures 103 to 105. As the nitrogen gas enters the computers 101, 102 and rises along their height, all possible smoldering fires are extinguished inside the computers.

The operation of the system can—in accordance with the above—also be described as follows:

1. In the first phase, the fumes and smoke gases, and the heat are sucked out of the room by spraying only water with a high pressure through the nozzles 1, 2, 1*a*', 1*b*', 2*a*', 2*b*'. When the water is sprayed, a strong suction effect is produced and the fumes sucked into the pipe net 3 and the pipe systems 3*a*', 3*b*' must pass the water mist which is purified in the pipe nets and the pipe systems. When only water mist, i.e. without nitrogen, is sprayed through the pipe net and it must pass at least one elbow pipe, the mist transforms into water again, which is collected in a tank (not shown) or forced down in a sewer (not shown), and thus the contaminated water is prevented from entering the room 100 containing sensitive electronic equipment. A net or mesh (not shown) in the pipe net and the pipe systems can produce the same effect as the elbow pipe (curved pipe) to prevent fumes containing extinguishing gas from being sprayed into the room and into the subfloor space. Purified air (without smoke gases and fumes and without water) is thus sprayed out of the pipe nets and the pipe systems through the exhaust openings 4, 5, 45*a*', 45*b*'.

2. When gas is fed into the water mist, and the accumulators 15 and 15' are used, the water drops are further divided, attaining a higher velocity and being thus capable of going past the elbow pipes without transforming into water again. In this case, the extinguishing liquid intermixed with gas is capable of emerging from the pipe net 3 and the pipe systems 3*a*', 3*b*' and extinguishes the fire.

3. The extinguishing in the subfloor 23 is brought about by intermixing the water mist with the gas, which makes the gas/water mixture heavier than air. The pressure is also increased in the subfloor and when a sufficient concentration is achieved, the gas/water mixture rises into the computers via the air inlets 103, 105. One reason is also that the nitrogen/water mixture is colder than the temperature in the room above, and thus the mixture rises to the warmer room. Tests have shown that the higher a computer or device, the faster the extinguishing. The chimney effect is greater in the case of higher devices.

Thus the system in FIG. 1 functions, in short, in such a way that smoke is sucked out and purified by spraying water mist, after which the composition of the mist is changed by spraying mist containing a relatively large amount of nitrogen gas and very little water. The water component of the mist forces the nitrogen gas down towards the floor level. When the water further sinks, the nitrogen gas is separated from the mist and rises, which extinguishes any fires possibly still smoldering. No electricity is required for operating the installation, which is a great advantage, since electricity is not always available when there is a fire.

The invention has in the foregoing been described with reference to one example only. It is pointed out that the invention can as regards its details vary in many ways within the scope of the enclosed claims. Thus the dimension and the shape of the pipe systems and pipe net, for example, may vary, the number of spray heads may vary, the number of spray and suction openings may vary. The number of spray openings and suction openings of the intermediate pipe parts and sections can be, for example, 2 to 20. It is also conceivable that the intermediate pipe parts may have—particularly if the intermediate pipe parts are long—more than one spray head of such a type that it is capable of generating extinguishing medium in the form of a finely divided water mist with a great penetrating ability and a simultaneous suction near the spray head. By placing these spray heads at a suitable distance after one another and arranging them to spray in the same direction, a strengthening of the finely divided water mist is achieved by said suction. It is also conceivable that one spray head or more may have been placed in the elongated first pipe part and the elongated second part, the spray heads supplementing or replacing the spray head/spray heads in the intermediate part. The first elongated pipe section does not necessarily have to be directed parallel to the second elongated pipe section, although such a construction is simple, takes up very little space in the room and produces a good result. When an extinguishing medium source with a hydraulic accumulator is used, the throttle can alternatively be constructed, for example, as an aperture made in the pipe wall of the rising tube at the lowermost end of the rising tube. The number of side openings in the rising tube can be much larger than what has been shown in the figures. It is also conceivable that there may be only one side opening. The suction unit, i.e. the pipe system, in the upper part of the room or space may only be a vertical pipe provided with a suction opening at the upper end and an elbow (to prevent the water from flowing out into the room) and a spray opening at the lower end. To achieve a more even distribution, it is, however, preferable to use a longer pipe at the level of the ceiling and a lower pipe at the floor level. As regards small rooms, one pipe in a room is sufficient; larger rooms require two or more pipes with double spray heads at each end of the pipe. It should be pointed out that the invention can be realized with a drive source without a hydraulic accumulator. However, a hydraulic accumulator according to the disclosure of the enclosed claims and to FIG. 1 is particularly suited for producing such finely divided liquid mist which is required in the present invention.

We claim:

1. Installation for fighting fire in a space (100), whereby the installation comprises a spray head (1*a*', 2*a*', 1*b*', 2*b*'; 1"; 1'"; 1""; 2"") of such a type that it is capable of producing extinguishing medium in the form of a finely divided liquid mist with a great penetrating ability and a simultaneous suction near the spray head, characterized in that the spray head (1*a*', 2*a*', 1*b*', 2*b*'; 1"; 1'"; 1""; 2"") is arranged in a pipe (3*a*40 , 3*b*'; 3"; 3'"; 3"") with a suction opening (67*a*', 67*b*') at a distance of 1 to 10 m from the floor level (24) of the room and a spray opening (45*a*', 45*b*') near the floor level, whereby the spray head is arranged to spray in the direction from the suction opening to the spray opening to create a suction in the suction opening.

2. Installation according to claim 1, characterized in that the pipe constitutes part of a pipe system (3*a*'; 3"; 3'"; 3"") comprising a plurality of spray openings (45*a*'; 45"; 45'"; 45"") for spraying extinguishing medium in the form of mist out of the pipe system at least essentially along the floor (24) and a plurality of suction openings (67*a*'; 67";; 67'"; 67"") for sucking smoke gases into the pipe system, whereby the pipe system has a first elongated pipe section (910*a*'; 910*a*"; 910*a*'"; 910*a*"") and a second elongated pipe section (811*a*'; 811*a*"; 811*a*'"; 811*a*""), and an intermediate pipe section (12*a*', 13*a*'; 13*a*"; 13*a*'"; 12*a*"", 13*a*"") which connects the first elongated pipe section with the second elongated pipe section, whereby the spray openings (45*a*'; 45"; 45'"; 45"") are arranged in the second elongated pipe section (811*a*'; 811*a*"; 811*a*'"; 811*a*"") in the longitudinal direction thereof and the suction openings (67*a*'; 67"; 67'"; 67"") are arranged in the first elongated pipe section (910*a*'; 910*a*"; 910*a*'"; 910*a*"") in the longitudinal direction thereof, whereby the second elongated pipe section (811*a*'; 811*a*"; 811*a*'"; 811*a*"") is arranged near the floor level (24) of the space and the first elongated pipe section (910*a*'; 910*a*"; 910*a*'"; 910*a*"") is arranged at a distance of 1 to 10 m above the floor level (24).

3. Installation according to claim 2, characterized in that the first elongated pipe section (910*a*'; 910*a*"; 910*a*'"; 910*a*"") is directed at least essentially parallel to the second elongated pipe section (811*a*'; 811*a*"; 811*a*'"; 811*a*"").

4. Installation according to claim 2, characterized in that the installation comprises a further pipe system (3*b*') comprising a plurality of spray openings (45*b*') for spraying extinguishing medium in the form of mist out of the pipe system at least mainly along the floor (24) and a plurality of suction openings (67*b*'), whereby the further pipe system has a first elongated pipe section (910*b*') and a second elongated pipe section (811*b*'), and an intermediate pipe section (12*b*', 13*b*') which connects the first elongated pipe section with the second elongated pipe section, whereby the spray openings (45*b*') are arranged in the second elongated pipe section (811*b*') in the longitudinal direction thereof and the suction openings (67*b*') are arranged in the first elongated pipe section (910*b*') in the longitudinal direction thereof, whereby the second elongated pipe section (811*b*') is arranged near the floor level (24) of the room and the first elongated pipe section (910*b*') is arranged at a distance of 1 to 10 m above the floor level.

5. Installation according to claim 4, characterized in that the first elongated pipe section (910*b*') is directed at least essentially parallel to the second elongated pipe section (811*b*').

6. Installation according to claim 4, characterized in that the further pipe system (3*b*') is arranged at such a distance from the pipe system (3*a*') so that the pipe systems (3*a*', 3*b*') are placed near the opposite walls of the room (100).

7. Installation according to claim 1 for a room (100) with a subfloor (23), characterized in that the installation further comprises a pipe net (3) arranged in the subfloor (23), whereby at least one spray head (1, 2) has been arranged in the pipe net to spray extinguishing medium in the form of mist into the pipe net, whereby the pipe net comprises spray openings (4, 5) for spraying mist out of the pipe net and suction openings (6, 7) for sucking and smoke gases into the pipe net and for producing a flow of extinguishing medium from the spray openings towards the suction openings, whereby the pipe net has a first elongated pipe part (910) and a second elongated pipe part (811), and an intermediate pipe part (12, 13) connecting the first elongated pipe part with the second elongated pipe part, whereby the first elongated pipe part is directed at least essentially parallel to the second elongated pipe part, and the spray openings and the suction openings are arranged in the elongated pipe parts in the longitudinal direction of the elongated pipe parts.

8. Installation according claim 7, characterized in that the spray head (1, 2) has been arranged in the intermediate pipe part (12, 13).

9. Installation according to claim 7, characterized in that the pipe net (3) is rectangular, whereby the intermediate pipe part comprises a first intermediate pipe part (12) and a second intermediate pipe part (13), which pipe parts (12, 13) are essentially parallel and are located at a distance from one another, whereby the spray head (1) has been arranged in the first intermediate pipe part (12), and that the installation comprises a further spray head (2) of such a type that it is capable of producing extinguishing medium in the form of a finely divided liquid mist with a great penetrating ability and a simultaneous suction near the further spray head (2), which further spray head has been arranged in the second intermediate pipe part (13).

10. Installation according to claim 9, characterized in that the first elongated pipe part (910) comprises both spray openings (5) and suction openings (6) so that the spray openings are arranged in a first section (9) of the first elongated pipe part and the suction openings are arranged in a second section (10) of the first elongated pipe part, and that the second elongated pipe part (811) comprises both spray openings (4) and suction openings (7) so that the spray openings are arranged in a first section (8) of the second elongated pipe part and the suction openings are arranged in a second section (11) of the second elongated pipe part, whereby the spray openings of the second elongated pipe part are arranged to spray towards the suction openings of the second elongated pipe part at least essentially in a direction parallel to the intermediate pipe parts (12, 13) and spray openings of the second elongated pipe part are arranged to spray towards the suction openings of the first elongated pipe part at least essentially in a direction parallel to the intermediate pipe parts.

11. Installation according to claim 7, characterized in that the first elongated pipe part (910), and the second elongated pipe section (811*a*') and the first elongated pipe section (910*a*') of the pipe system (3*a*') are arranged to be at least essentially in the same plane which is essentially transverse to the plane of the floor (24), and that the second elongated pipe part (810) and the second elongated pipe section (811*b*') and the first elongated pipe section (910*b*') of the further elongated pipe system (3*b*') are arranged to be at least essentially in the same plane which is at least essentially transverse to the plane of the floor (24).

12. Installation according to claim 11, characterized in that the pipe system (3*a*') is rectangular, whereby the intermediate pipe section comprises a first intermediate pipe section (13*a*') and a second intermediate pipe section (12*a*'), which pipe sections (12*a*', 13*a*') are essentially parallel and are located at a distance from one another, whereby the spray head (1*a*') has been arranged in the first intermediate pipe section (13*a*'), and that the installation comprises a further spray head (2*a*') of such a type that it is capable of generating extinguishing medium in the form of a finely divided liquid mist with a great penetrating ability and a simultaneous suction near the further spray head (2*a*'), which further spray head has been arranged in the second intermediate pipe section (12*a*').

13. Installation according to claim 7, characterized in that the spray head (1*a*', 2*a*', 1*b*', 2*b*') of the pipe system (3*a*', 3*b*') and the spray head (1, 2) of the pipe net (3) are connected to a drive unit (14) comprising a hydraulic accumulator (15, 15').

14. Installation according to claim 13, characterized in that the hydraulic accumulator (15, 15') comprises at least one pressure container (16*a*, 16*b*, 16') with a space for extinguishing liquid and a space for propellant gas.

15. Installation according to claim 14, characterized in that a gas source (21, 21') has been coupled to the pressure container (16*a*, 16*b*, 16') to provide said container with propellant gas.

16. Installation according to claim 15, characterized in that the extinguishing liquid in the pressure container (16*a*, 16*b*, 16') is a water-based liquid and that the gas source is formed by a pressure bottle (21, 21') with incombustible gas.

17. Installation according to claim 16, characterized in that the gas bottle is a nitrogen bottle (21, 21') charged to a pressure of 30 to 300 bar.

18. Installation according to claim 17, characterized in that the hydraulic accumulator (15') for the pipe system (3*a*', 3*b*') comprises a pressure container (16') with a rising tube (17') provided with at least one side opening (18') and a feed opening (19') located at the lower part of the pressure container for feeding extinguishing liquid into the rising tube and further to the spray head (1*a*', 2*a*', 2*b*', 2*b*') of the pipe system, whereby the rising tube (17') in the area below said at least one side opening has a throttle (20').

19. Installation according to claim 18, characterized in that the spray heads (1, 2) of the pipe net (3) are arranged to be operated by a hydraulic accumulator (15) which is separate from the hydraulic accumulator (15) for the pipe system (3*a*', 3*b*') and which comprises two pressure bottles (16*a*, 16*b*) of which one (16*a*) is arranged to empty its liquid contents entirely into an outfeed pipe (110) which leads to the spray head (1, 2) of the pipe net, after which the other (16*b*) is arranged to be emptied so that propellant gas from the gas bottle is simultaneously fed to the outfeed pipe to obtain finely divided liquid mist.

20. Installation according to claim 3, characterized in that the pipe system (3*a*') is rectangular, whereby the intermediate pipe section comprises a first intermediate pipe section (13*a*') and a second intermediate pipe section (12*a*'), which pipe sections (12*a*', 13*a*') are essentially parallel and are located at a distance from one another, whereby the spray head (1*a*') has been arranged in the first intermediate pipe section (13*a*'), and that the installation comprises a further spray head (2*a*') of such a type that it is capable of generating extinguishing medium in the form of a finely divided liquid mist with a great penetrating ability and a simultaneous suction near the further spray head (2*a*'), which further spray head has been arranged in the second intermediate pipe section (12*a*').

* * * * *

UNITED STATES PATENT AND TRADEMARK OFFICE

CERTIFICATE OF CORRECTION

PATENT NO. : 5,992,530

DATED : November 30, 1999

INVENTOR(S) : Gordan SUNDHOLM

It is certified that error appears in the above-identified patent and that said Letters Patent are hereby corrected as shown below:

Please insert the following:
- - [30] Foreign Application Priority Data
Sep. 5, 1996 [FI] Finland .....963486
Sep. 13, 1996 [FI] Finland .....963642
Mar. 17, 1997 [FI] Finland.....971118 - -.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*